US010204580B2

(12) United States Patent
Dai

(10) Patent No.: US 10,204,580 B2
(45) Date of Patent: Feb. 12, 2019

(54) SCAN-DRIVING DEVICE WITH DETECTIVE-DRIVING CIRCUIT

(71) Applicant: Shenzhen China Star Optoelectronics Technology Co., Ltd., Shenzhen (CN)

(72) Inventor: Chao Dai, Shenzhen (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 0 days.

(21) Appl. No.: 14/904,957

(22) PCT Filed: Nov. 12, 2015

(86) PCT No.: PCT/CN2015/094470

§ 371 (c)(1),
(2) Date: Jan. 14, 2016

(87) PCT Pub. No.: WO2017/075843

PCT Pub. Date: May 11, 2017

(65) Prior Publication Data

US 2017/0132984 A1 May 11, 2017

(30) Foreign Application Priority Data

Nov. 6, 2015 (CN) ..... 2015 1 0750211

(51) Int. Cl.
*G09G 3/36* (2006.01)

(52) U.S. Cl.
CPC ... *G09G 3/3677* (2013.01); *G09G 2300/0413* (2013.01); *G09G 2310/08* (2013.01); *G09G 2320/045* (2013.01); *G09G 2330/12* (2013.01)

(58) Field of Classification Search
CPC ..... G09G 3/3677; G09G 2300/0413; G09G 2310/08; G09G 2320/045; G09G 2330/12
See application file for complete search history.

(56) References Cited

U.S. PATENT DOCUMENTS

| | | | | |
|---|---|---|---|---|
| 8,994,629 | B2 | 3/2015 | Kim | |
| 9,019,187 | B2 | 4/2015 | Moon et al. | |
| 9,190,169 | B2 | 11/2015 | Han et al. | |
| 9,269,300 | B2 | 2/2016 | Yang et al. | |
| 9,495,898 | B2 | 11/2016 | Dai | |
| 2003/0231735 | A1 | 12/2003 | Moon et al. | |
| 2004/0246246 | A1 * | 12/2004 | Tobita | G09G 3/20 345/205 |

(Continued)

FOREIGN PATENT DOCUMENTS

| | | |
|---|---|---|
| CN | 101359440 | 2/2009 |
| CN | 101765876 | 6/2010 |

(Continued)

*Primary Examiner* — Kwang-Su Yang

(57) ABSTRACT

A scan-driving device is disclosed herein. The scan-driving device comprises a plurality of scan-driving circuits, a detective-driving circuit, and a modulating module. The scan-driving circuit comprises a n up-pull control module, an up-pull module, a down-transfer module, a down-pull module, a down-pull-sustain module, a bootstrap capacitor. The detective-driving circuit in the scan-driving device of the present invention is able to better maintain the ability of down-pull-sustain of the down-pull-sustain module, whereby the stability of the scan-driving device is increased.

19 Claims, 4 Drawing Sheets

(56) References Cited

U.S. PATENT DOCUMENTS

| | | | | |
|---|---|---|---|---|
| 2009/0040161 | A1* | 2/2009 | Baek | G11C 19/28 345/94 |
| 2010/0188385 | A1 | 7/2010 | Boiko | |
| 2011/0150169 | A1* | 6/2011 | Lin | G11C 19/28 377/64 |
| 2014/0176410 | A1* | 6/2014 | Ma | G09G 3/3622 345/92 |

FOREIGN PATENT DOCUMENTS

| | | |
|---|---|---|
| CN | 103700333 | 4/2014 |
| CN | 103714770 | 4/2014 |
| CN | 103714784 | 4/2014 |
| CN | 104078019 | 10/2014 |
| WO | WO 2013/166827 | 11/2013 |

* cited by examiner

SCAN-DRIVING DEVICE WITH DETECTIVE-DRIVING CIRCUIT

RELATED APPLICATIONS

This application is a National Phase of PCT Patent Application No. PCT/CN2015/094470 having International filing date of Nov. 12, 2015, which claims the benefit of priority of Chinese Patent Application No. 201510750211.1 filed on Nov. 6, 2015. The contents of the above applications are all incorporated by reference as if fully set forth herein in their entirety.

FIELD AND BACKGROUND OF THE INVENTION

The present invention relates to the field of display driving technology, and more particularly to a scan-driving device.

Gate Driver on Array (GOA) is a driving circuit provided on the array substrate of a conventional thin film transistor (TFT) liquid crystal display (LCD); the GOA is used to complete a driving of scanning of the scan lines progressively. A conventional scan-driving circuit comprises an up-pull control module, a first up-pull module, a first down-transfer module, a first down-pull module, a first bootstrap capacitor, and a first down-pull-sustain module.

Please refer to FIG. 1, which is a structural illustrative drawing of a scan-driving circuit of the conventional art. 101 is an up-pull control module, 102 is an up-pull module, 103 is a down-transfer module, 104 is a down-pull module, 105 is a down-pull-sustain module, and C is a bootstrap capacitor. Operation times of the up-pull control module 101, the up-pull module 102, the down-transfer module 103, and the down-pull module 104 are short, most of the time is at rest mode with low potential, however, and the down-pull-sustain module 105 is at work mode with high potential for a long time.

Hence, to the scan-driving circuit, a switch T32 for maintaining low potential of G_N and a switch T42 for maintaining low potential of Q_N are the two elements most likely to fail. Furthermore, if the down-pull-sustain module 105 maintains work mode for a long time, the ability of down-pull-sustain of the down-pull-sustain module 105 will decrease, and finally the scan-driving circuit will fail.

So there is a need to provide a scan-driving device to solve the technical problem existing in the conventional art.

SUMMARY OF THE INVENTION

An objective of the present invention is to provide a scan-driving device which is able to better maintain the ability of down-pull-sustain of the down-pull-sustain module, to solve the technical problem of the decrease of the ability of down-pull-sustain of the down-pull-sustain module of the conventional art, which leads to the scan-driving circuit failure.

To solve the above problem, the present invention provides technical proposals as below:

The present invention provides a scan-driving device, which comprises:

A plurality of scan-driving circuits, being used to perform a driving operation on cascaded scan lines;

A detective-driving circuit, being used to detect a threshold-voltage-drift of a control switch of a down-pull-sustain module of the scan-driving circuit;

A modulating module, being used to perform adjustment to a control signal of the down-pull-sustain module, according to a detected result of the detective-driving circuit; and A plurality of dummy scan-driving circuits, being disposed before and after all of the scan-driving circuits of the scan-driving device, to filter unstable input signals;

Wherein the scan-driving circuit comprises:

A pull-up-control module, being used to receive a previous-stage down-transfer signal, and correspondingly generate a scan-voltage signal of the scan line according to the previous-stage down-transfer signal;

A pull-up module, being used to pull up a corresponding scan signal of the scan line according to the scan-voltage signal and a current-stage clock signal;

A down-transfer module, being used to transmit a current-stage down-transfer signal to a next-stage pull-up-control module;

A down-pull module, being used to pull down the corresponding scan signal of the scan line, according to a next-stage scan signal;

A down-pull-sustain module, being used to maintain low potential of the corresponding scan signal of the scan line, by using the control signal; and A bootstrap capacitor, being used to generate high potential of the corresponding scan signal of the scan line;

Wherein the detective-driving circuit comprises:

A pull-up-control module, being used to receive a previous-stage down-transfer signal, and correspondingly generate a scan-voltage signal of the scan line according to the previous-stage down-transfer signal;

A pull-up module, being used to pull up a corresponding scan signal of the scan line according to the scan-voltage signal and a current-stage clock signal;

A down-transfer module, being used to transmit a current-stage down-transfer signal to a next-stage pull-up-control module;

A down-pull module, being used to pull down the corresponding scan signal of the scan line, according to a next-stage scan signal;

A down-pull-sustain module, being used to maintain low potential of the corresponding scan signal of the scan line, by using the control signal;

A bootstrap capacitor, being used to generate high potential of the corresponding scan signal of the scan line; and A detecting module, being used to derive corresponding detected current under the action of a detected voltage and/or a starting signal, to detect the threshold-voltage-drift of the control switch of the down-pull-sustain module.

In the scan-driving device of the present invention, the down-pull-sustain module of the detective-driving circuit comprises a first switch, a second switch, a third switch, a fourth switch, and a fifth switch;

A control terminal of the first switch is inputted with the previous-stage down-transfer signal, an input terminal of the first switch is connected with an output terminal of the third switch, an output terminal of the first switch is connected with a common voltage source;

A control terminal of the second switch is inputted with the current-stage down-transfer signal, an input terminal of the second switch is connected with the output terminal of the third switch, an output terminal of the second switch is connected with the common voltage source;

A control terminal of the third switch is inputted with the control signal, an input terminal of the third switch is also inputted with the control signal, an output terminal of the third switch is connected with a control terminal of the fourth switch and a control terminal of the fifth switch;

An input terminal of the fourth switch is inputted with the scan-voltage signal of the scan line, an output terminal of the fourth switch is connected with the common voltage source;

An input terminal of the fifth switch is inputted with the scan signal of the scan line, an output terminal of the fifth switch is connected with the common voltage source.

In the scan-driving device of the present invention, the down-pull-sustain module of the detective-driving circuit comprises a first switch, a second switch, a third switch, a fourth switch, a fifth switch, a sixth switch, a seventh switch, and an eighth switch;

A control terminal of the first switch is inputted with the previous-stage down-transfer signal, an input terminal of the first switch is connected with an output terminal of the third switch, an output terminal of the first switch is connected with a common voltage source;

A control terminal of the second switch is inputted with the current-stage down-transfer signal, an input terminal of the second switch is connected with the output terminal of the third switch, an output terminal of the second switch is connected with the common voltage source;

A control terminal of the third switch is inputted with the control signal, an input terminal of the third switch is also inputted with the control signal, an output terminal of the third switch is connected with a control terminal of the eighth switch;

An input terminal of the fourth switch is inputted with the scan-voltage signal of the scan line, an output terminal of the fourth switch is connected with the common voltage source;

An input terminal of the fifth switch is inputted with the scan signal of the scan line, an output terminal of the fifth switch is connected with the common voltage source;

A control terminal of the sixth switch is inputted with the previous-stage down-transfer signal, an input terminal of the sixth switch is connected with an output terminal of the eighth switch, an output terminal of the sixth switch is connected with the common voltage source;

A control terminal of the seventh switch is inputted with the current-stage down-transfer signal, an input terminal of the seventh switch is connected with the output terminal of the eighth switch, an output terminal of the seventh switch is connected with the common voltage source;

A control terminal of the eighth switch is inputted with the control signal, an output terminal of the eighth switch is connected with a control terminal of the fourth switch and a control terminal of the fifth switch.

In the scan-driving device of the present invention, the detecting module comprises a ninth switch, a control terminal of the ninth switch and an input terminal of the ninth switch is inputted with the detected voltage, an output terminal of the ninth switch is connected with the input terminal of the fourth switch.

In the scan-driving device of the present invention, the detecting module comprises a ninth switch, a control terminal of the ninth switch is inputted with the starting signal, an input terminal of the ninth switch is inputted with the detected voltage, an output terminal of the ninth switch is connected with the input terminal of the fourth switch.

In the scan-driving device of the present invention, the detecting module comprises a ninth switch, a control terminal of the ninth switch and an input terminal of the ninth switch is inputted with the starting signal, an output terminal of the ninth switch is connected with the input terminal of the fourth switch.

In the scan-driving device of the present invention, the pull-up-control module comprises a tenth switch, a control terminal of the tenth switch is inputted with the previous-stage down-transfer signal, an input terminal of the tenth switch is inputted with the previous-stage down-transfer signal, an output terminal of the tenth switch is connected with the up-pull module, the down-pull module, the down-pull-sustain module, the down-transfer module, and the bootstrap capacitor;

The up-pull module comprises an eleventh switch, a control terminal of the eleventh switch is connected with the output terminal of the tenth switch, an input terminal of the eleventh switch is inputted with the current-stage clock signal, an output terminal of the eleventh switch outputs a current-stage scan signal;

The down-transfer module comprises a twelfth switch, a control terminal of the twelfth switch is connected with the output terminal of the tenth switch, an input terminal of the twelfth switch is inputted with the current-stage clock signal, an output terminal of the twelfth switch outputs the current-stage down-transfer signal;

The down-pull module comprises a thirteen switch and a fourteen switch, a control terminal of the thirteen switch is inputted with the next-stage scan signal, an input terminal of the thirteen switch is connected with the output terminal of the ninth switch, an output terminal of the thirteen switch is connected with the common voltage source;

A control terminal of the fourteen switch is inputted with the next-stage scan signal, an input terminal of the fourteen switch is connected with the current-stage scan signal, an output terminal of the fourteen switch is connected with the common voltage source;

The bootstrap capacitor is disposed between the output terminal of the tenth switch and the output terminal of the eleventh switch.

In the scan-driving device of the present invention, the detecting module is disposed within one of the dummy scan-driving circuits.

In the scan-driving device of the present invention, the detecting module is disposed between two of the dummy scan-driving circuits which are in front of the scan-driving device.

In the scan-driving device of the present invention, the detecting module is disposed between two of the dummy scan-driving circuits which are behind the scan-driving device.

The present invention further provides another scan-driving device, which comprises:

A plurality of scan-driving circuits, being used to perform driving operation on cascaded scan lines;

A detective-driving circuit, being used to detect a threshold-voltage-drift of a control switch of a down-pull-sustain module of the scan-driving circuit; and A modulating module, being used to perform adjustment to a control signal of the down-pull-sustain module, according to a detected result of the detective-driving circuit;

Wherein the scan-driving circuit comprises:

A pull-up-control module, being used to receive a previous-stage down-transfer signal, and correspondingly generate a scan-voltage signal of the scan line according to the previous-stage down-transfer signal;

A pull-up module, being used to pull up a corresponding scan signal of the scan line according to the scan-voltage signal and a current-stage clock signal;

A down-transfer module, being used to transmit a current-stage down-transfer signal to a next-stage pull-up-control module;

A down-pull module, being used to pull down the corresponding scan signal of the scan line, according to a next-stage scan signal;

A down-pull-sustain module, being used to maintain low potential of the corresponding scan signal of the scan line, by using the control signal; and A bootstrap capacitor, being used to generate high potential of the corresponding scan signal of the scan line.

In the scan-driving device of the present invention, the detective-driving circuit comprises:

A pull-up-control module, being used to receive a previous-stage down-transfer signal, and correspondingly generate a scan-voltage signal of the scan line according to the previous-stage down-transfer signal;

A pull-up module, being used to pull up a corresponding scan signal of the scan line according to the scan-voltage signal and a current-stage clock signal;

A down-transfer module, being used to transmit a current-stage down-transfer signal to a next-stage pull-up-control module;

A down-pull module, being used to pull down the corresponding scan signal of the scan line, according to a next-stage scan signal;

A down-pull-sustain module, being used to maintain low potential of the corresponding scan signal of the scan line, by using the control signal;

A bootstrap capacitor, being used to generate high potential of the corresponding scan signal of the scan line; and A detecting module, being used to derive corresponding detected current under the action of a detected voltage and/or a starting signal, to detect the threshold-voltage-drift of the control switch of the down-pull-sustain module.

In the scan-driving device of the present invention, the down-pull-sustain module of the detective-driving circuit comprises a first switch, a second switch, a third switch, a fourth switch, and a fifth switch;

A control terminal of the first switch is inputted with the previous-stage down-transfer signal, an input terminal of the first switch is connected with an output terminal of the third switch, an output terminal of the first switch is connected with a common voltage source;

A control terminal of the second switch is inputted with the current-stage down-transfer signal, an input terminal of the second switch is connected with the output terminal of the third switch, an output terminal of the second switch is connected with the common voltage source;

A control terminal of the third switch is inputted with the control signal, an input terminal of the third switch is also inputted with the control signal, an output terminal of the third switch is connected with a control terminal of the fourth switch and a control terminal of the fifth switch;

An input terminal of the fourth switch is inputted with the scan-voltage signal of the scan line, an output terminal of the fourth switch is connected with the common voltage source;

An input terminal of the fifth switch is inputted with the scan signal of the scan line, an output terminal of the fifth switch is connected with the common voltage source.

In the scan-driving device of the present invention, the down-pull-sustain module of the detective-driving circuit comprises a first switch, a second switch, a third switch, a fourth switch, a fifth switch, a sixth switch, a seventh switch, and an eighth switch;

A control terminal of the first switch is inputted with the previous-stage down-transfer signal, an input terminal of the first switch is connected with an output terminal of the third switch, an output terminal of the first switch is connected with a common voltage source;

A control terminal of the second switch is inputted with the current-stage down-transfer signal, an input terminal of the second switch is connected with the output terminal of the third switch, an output terminal of the second switch is connected with the common voltage source;

A control terminal of the third switch is inputted with the control signal, an input terminal of the third switch is also inputted with the control signal, an output terminal of the third switch is connected with a control terminal of the eighth switch;

An input terminal of the fourth switch is inputted with the scan-voltage signal of the scan line, an output terminal of the fourth switch is connected with the common voltage source;

An input terminal of the fifth switch is inputted with the scan signal of the scan line, an output terminal of the fifth switch is connected with the common voltage source;

A control terminal of the sixth switch is inputted with the previous-stage down-transfer signal, an input terminal of the sixth switch is connected with an output terminal of the eighth switch, an output terminal of the sixth switch is connected with the common voltage source;

A control terminal of the seventh switch is inputted with the current-stage down-transfer signal, an input terminal of the seventh switch is connected with the output terminal of the eighth switch, an output terminal of the seventh switch is connected with the common voltage source;

A control terminal of the eighth switch is inputted with the control signal, an output terminal of the eighth switch is connected with a control terminal of the fourth switch and a control terminal of the fifth switch.

In the scan-driving device of the present invention, the detecting module comprises a ninth switch, a control terminal of the ninth switch and an input terminal of the ninth switch are inputted with the detected voltage, an output terminal of the ninth switch is connected with the input terminal of the fourth switch.

In the scan-driving device of the present invention, the detecting module comprises a ninth switch, a control terminal of the ninth switch is inputted with the starting signal, an input terminal of the ninth switch is inputted with the detected voltage, an output terminal of the ninth switch is connected with the input terminal of the fourth switch.

In the scan-driving device of the present invention, the detecting module comprises a ninth switch, a control terminal of the ninth switch and an input terminal of the ninth switch are inputted with the starting signal, an output terminal of the ninth switch is connected with the input terminal of the fourth switch.

In the scan-driving device of the present invention, the pull-up-control module comprises a tenth switch, a control terminal of the tenth switch is inputted with the previous-stage down-transfer signal, an input terminal of the tenth switch is inputted with the previous-stage down-transfer signal, an output terminal of the tenth switch is connected with the up-pull module, the down-pull module, the down-pull-sustain module, the down-transfer module, and the bootstrap capacitor;

The up-pull module comprises an eleventh switch, a control terminal of the eleventh switch is connected with the output terminal of the tenth switch, an input terminal of the eleventh switch is inputted with the current-stage clock signal, an output terminal of the eleventh switch outputs a current-stage scan signal;

The down-transfer module comprises a twelfth switch, a control terminal of the twelfth switch is connected with the output terminal of the tenth switch, an input terminal of the twelfth switch is inputted with the current-stage clock signal, an output terminal of the twelfth switch outputs the current-stage down-transfer signal;

The down-pull module comprises a thirteen switch and a fourteen switch, a control terminal of the thirteen switch is inputted with the next-stage scan signal, an input terminal of the thirteen switch is connected with the output terminal of the ninth switch, an output terminal of the thirteen switch is connected with the common voltage source;

A control terminal of the fourteen switch is inputted with the next-stage scan signal, an input terminal of the fourteen switch is connected with the current-stage scan signal, an output terminal of the fourteen switch is connected with the common voltage source;

The bootstrap capacitor is disposed between the output terminal of the tenth switch and the output terminal of the eleventh switch.

In the scan-driving device of the present invention, the scan-driving device further comprises a plurality of dummy scan-driving circuits, being disposed before and after all of the scan-driving circuits of the scan-driving device, to filter unstable input signals.

In the scan-driving device of the present invention, the detecting module is disposed within one of the dummy scan-driving circuits, is disposed between two of the dummy scan-driving circuits which are in front of the scan-driving device, or is disposed between two of the dummy scan-driving circuits which are in behind of the scan-driving device.

With comparison of the conventional art, the present invention can better maintain the ability of down-pull-sustain of the down-pull-sustain module by disposing the detective-driving circuit, and the stability of the scan-driving device is increased. The technical problem of the decrease of the ability of down-pull-sustain of the down-pull-sustain module of the conventional art will lead to the scan-driving circuit failure.

DESCRIPTION OF SPECIFIC EMBODIMENTS OF THE INVENTION

Figure 1:
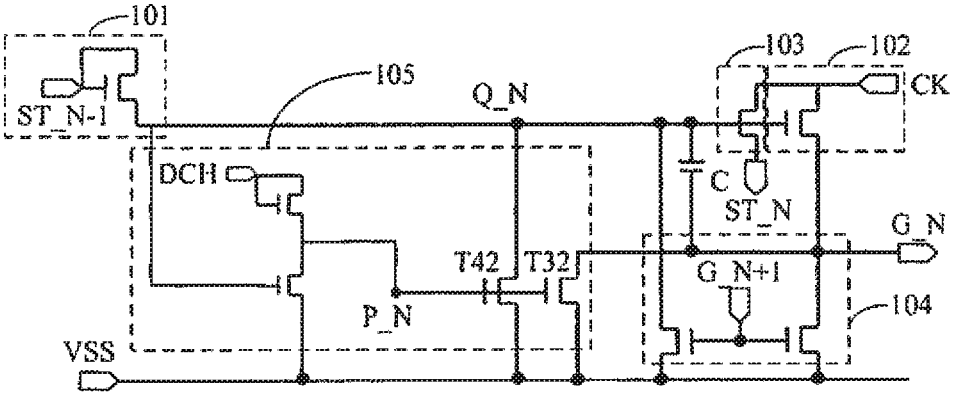
FIG. 1 (Prior Art)
FIG. 1 is a structural illustrative drawing of a scan-driving circuit of a conventional art.

The following description of each embodiment, with reference to the accompanying drawings, is used to exemplify specific embodiments which may be carried out in the present invention. Directional terms mentioned in the present invention, such as "top", "bottom", "front", "back", "left", "right", "inside", "outside", "side", etc., are only used with reference to the orientation of the accompanying drawings. Therefore, the used directional terms are intended to illustrate, but not to limit, the present invention. In the drawings, units with similar structures are marked with the same labels.

Figure 2:
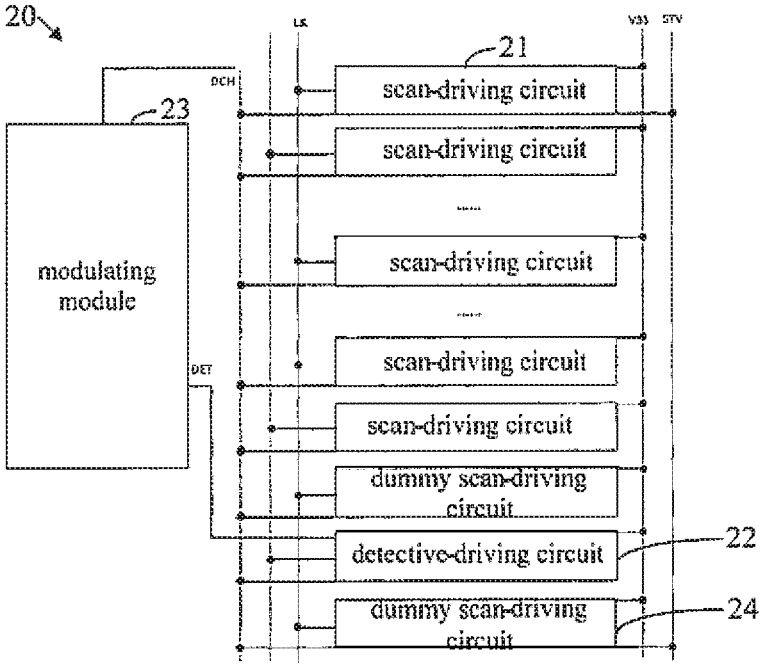
FIG. 2 is a structural illustrative drawing of a scan-driving device of a preferred embodiment of the present invention.

FIG. 2 is a structural illustrative drawing of a scan-driving device of a preferred embodiment of the present invention. The scan-driving device 20 comprises a plurality of scan-driving circuits 21, a detective-driving circuit 22, and a modulating module 23. The plurality of scan-driving circuits 21 are used to perform driving operation on cascaded scan lines. The detective-driving circuit 22 is used to detect a threshold-voltage-drift of a control switch of a -down-pull-sustain module (not shown, referring to the down-pull sustain module 105 of FIG. 1) of the scan-driving circuit 21 of the scan-driving device 20. The modulating module 23 is used to perform adjustment to a control signal DCH of the down-pull-sustain module of the scan-driving circuit 21, according to a detected result of the detective-driving circuit 22.

As FIG. 1 shows, the schematic structure of the scan-driving circuit 21 of the present embodiment of the present invention is similar the conventional art, which also includes an up-pull control module 101, an up-pull module 102, a down-transfer module 103, a down-pull module 104, a down-pull-sustain module 105, and a bootstrap capacitor C. The pull-up-control module 101 is used to receive a previous-stage down-transfer signal ST_N−1, and correspondingly generate a scan-voltage signal Q_N of the scan line according to the previous-stage down-transfer signal ST_N−1. The pull-up module 102 is used to pull up a corresponding scan signal of the scan line G_N according to the scan-voltage signal Q_N and a current-stage clock signal CK. The down-transfer module 103 is used to transmit a current-stage down-transfer signal ST_N to a next-stage pull-up-control module 101. The down-pull module 104 is used to pull down the corresponding scan signal of the scan line G_N, according to a next-stage scan signal G_N+1. The down-pull-sustain module 105 is used to maintain low potential of the corresponding scan signal of the scan line G_N, by using the control signal SCH. The bootstrap capacitor C is used to generate high potential of the corresponding scan signal of the scan line G_N.

Figure 3A:
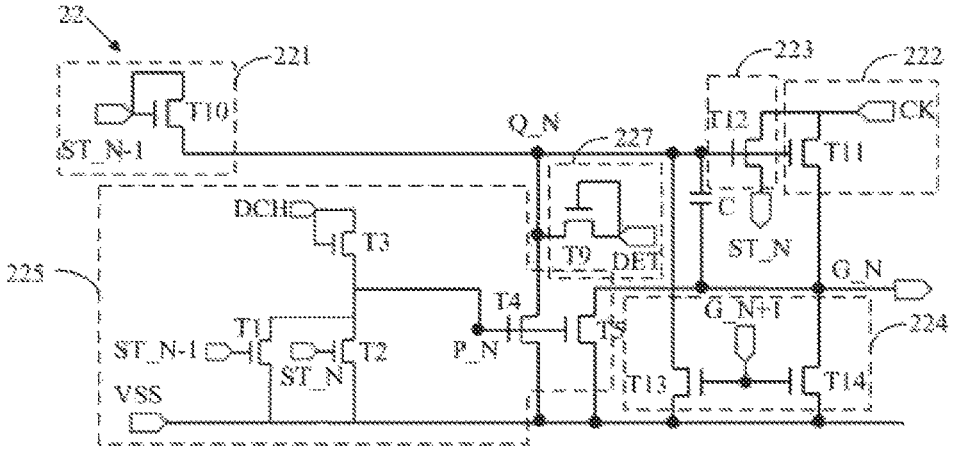
FIG. 3A is a structural illustrative drawing of a detective-driving circuit of the scan-driving device of a first preferred embodiment of the present invention.

Refer to FIG. 3A, which is a structural illustrative drawing of the detective-driving circuit 22 of the scan-driving device 20 of a first preferred embodiment of the present invention.

The detective-driving circuit 22 of the scan-driving device 20 of the first preferred embodiment of the present invention comprises an pull-up control module 221, an pull-up module 222, a down-transfer module 223, a down-pull module 224, a down-pull-sustain module 225, a bootstrap capacitor C, and a detecting module 227. The pull-up-control module 221 is used to receive a previous-stage down-transfer signal ST_N−1, and correspondingly generate a scan-voltage signal Q_N of the scan line according to the previous-stage down-transfer signal ST_N−1. The pull-up module 222 is used to pull up a corresponding scan signal G_N of the scan line according to the scan-voltage signal Q_N and a current-stage clock signal CK. The down-transfer module 223 is used to transmit a current-stage down-transfer signal ST_N to a next-stage pull-up-control module 221. The down-pull module 224 is used to pull down the corresponding scan signal G_N of the scan line, according to a next-stage scan signal G_N+1. The down-pull-sustain module 225 is used to maintain low potential of the corresponding scan signal G_N of the scan line, by using the control signal DCH. The bootstrap capacitor C is used to generate high potential of the corresponding scan signal G_N of the scan line. The detecting module 227 is used to derive corresponding detected current I under the action of a detected voltage DET and/or a starting signal STV, to detect the threshold-voltage-drift of the control switch of the down-pull-sustain module 225.

The down-pull-sustain module 225 comprises a first switch T1, a second switch T2, a third switch T3, a fourth switch T4, and a fifth switch T5. A control terminal of the first switch T1 is inputted with the previous-stage down-transfer signal ST_N−1, an input terminal of the first switch T1 is connected with an output terminal of the third switch T3, and an output terminal of the first switch T1 is connected with a common voltage source VSS.

A control terminal of the second switch T2 is inputted with the current-stage down-transfer signal ST_N, an input terminal of the second switch T2 is connected with the output terminal of the third switch T3, and an output terminal of the second switch T2 is connected with the common voltage source VSS.

A control terminal of the third switch T3 is inputted with the control signal DCH, an input terminal of the third switch T3 is also inputted with the control signal DCH, and an output terminal of the third switch T3 is connected with a control terminal of the fourth switch T4 and a control terminal of the fifth switch T5.

An input terminal of the fourth switch T4 is inputted with the scan-voltage signal Q_N of the scan line, and an output terminal of the fourth switch T4 is connected with the common voltage source VSS.

An input terminal of the fifth switch T5 is inputted with the scan signal of the scan line G_N, and an output terminal of the fifth switch T5 is connected with the common voltage source VSS.

The detecting module 227 comprises a ninth switch T9. A control terminal of the ninth switch T9 and an input terminal of the ninth switch T9 are inputted with the detected voltage DET, and an output terminal of the ninth switch T9 is connected with the input terminal of the fourth switch T4.

The pull-up-control module 221 comprises a tenth switch T10. A control terminal of the tenth switch T10 is inputted with the previous-stage down-transfer signal ST_N−1, an input terminal of the tenth switch T10 is inputted with the previous-stage down-transfer signal ST_N−1, and an output terminal of the tenth switch T10 is connected with the up-pull module 222, the down-pull module 224, the down-pull-sustain module 225, the down-transfer module 223, and the bootstrap capacitor C.

The up-pull module 222 comprises an eleventh switch T11. A control terminal of the eleventh switch T11 is connected with the output terminal of the tenth switch T10, an input terminal of the eleventh switch T11 is inputted with the current-stage clock signal CK, and an output terminal of the eleventh switch T11 outputs a current-stage scan signal G_N.

The down-transfer module 223 comprises a twelfth switch T2. A control terminal of the twelfth switch T12 is connected with the output terminal of the tenth switch T10, an input terminal of the twelfth switch T12 is inputted with the current-stage clock signal CK, and an output terminal of the twelfth switch T12 outputs the current-stage down-transfer signal ST_N.

The down-pull module 224 comprises a thirteenth switch T13 and a fourteenth switch T14. A control terminal of the thirteenth switch T13 is inputted with the next-stage scan signal G_N+1, an input terminal of the thirteenth switch T13 is connected with the output terminal of the ninth switch T9, an output terminal of the thirteenth switch T13 is connected with the common voltage source VSS. A control terminal of the fourteenth switch T14 is inputted with the next-stage scan signal G_N+1, an input terminal of the fourteenth switch T14 is connected with the current-stage scan signal G_N, and an output terminal of the fourteenth switch T14 is connected with the common voltage source VSS.

The bootstrap capacitor C is disposed between the output terminal of the tenth switch T10 and the output terminal of the eleventh switch T11.

As shown in FIG. 2, the scan-driving device 20 of the preferred embodiment, the scan-driving device 20 further comprises a plurality of dummy scan-driving circuits 24. The dummy scan-driving circuits 24 are disposed behind all of the scan-driving circuits 21 of the scan-driving device 20. The structure of the dummy scan-driving circuits 24 are the same as the structure of the scan-driving circuits 21. Because the dummy scan-driving circuits 24 do not output scan-voltage signal, the dummy scan-driving circuits 24 are able to filter unstable input signals. In the preferred embodiment, the detective-driving circuit 22 is disposed between two of the dummy scan-driving circuits 24 which are located in a rear part of the scan-driving device 20, to derive the threshold-voltage-drift of the control switch of the down-pull-sustain module 225 of the scan-driving circuit 21, by detecting the threshold-voltage-drift of the control switch of the down-pull-sustain module 225 of the detective-driving circuit 22. The threshold-voltage-drift of the control switch of the down-pull-sustain module of the scan-driving circuit 21 and the threshold-voltage-drift of the control switch of the down-pull-sustain module 225 of the detective-driving circuit 22 are the same.

Of course, if the dummy scan-driving circuits 24 are disposed in front of all of the scan-driving circuits 21, then the detective-driving circuit 22 is disposed between the two of the dummy scan-driving circuits 24 which are in a front part of the scan-driving device 20. Or the detective-driving circuit 22 can be disposed directly within one of the dummy scan-driving circuits 24; in other words, the detective-driving circuit 22 is used to substitute one of the dummy scan-driving circuits 24.

Figure 3B:
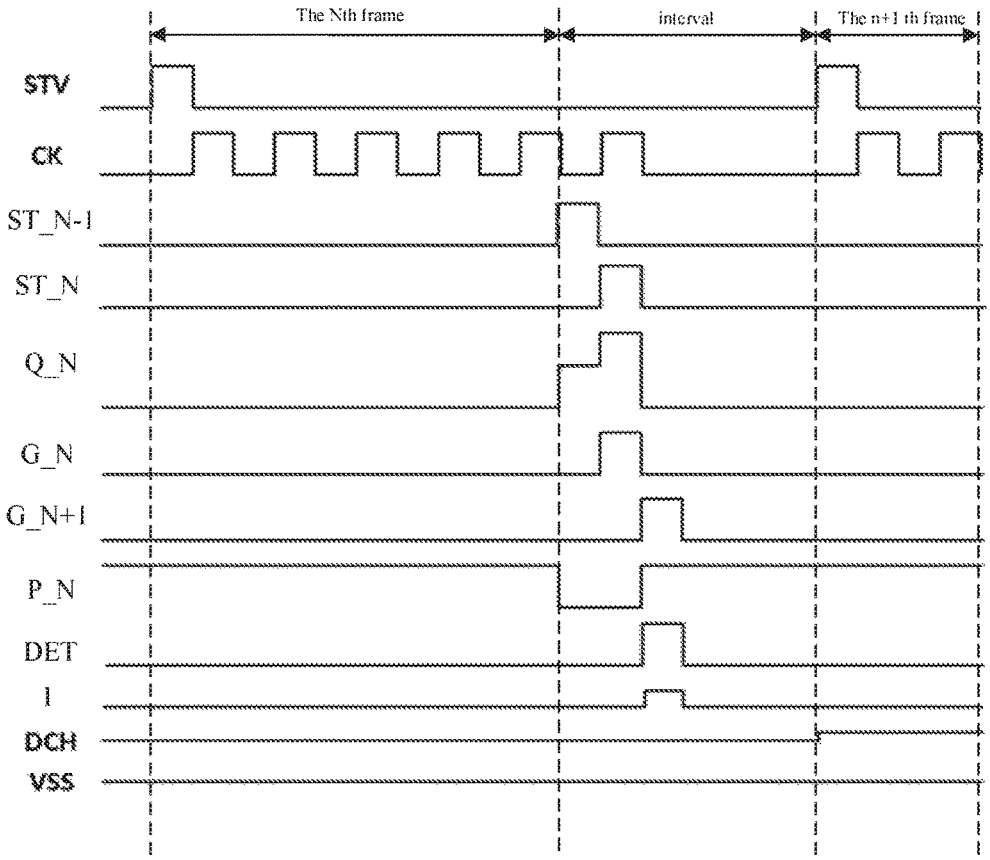
FIG. 3B is a time-sequence drawing of a detective-driving circuit of the scan-driving device of a first preferred embodiment of the present invention.

Please refer to FIG. 3A and FIG. 3B. FIG. 3B is a time-sequence drawing of the detective-driving circuit of the scan-driving device of the first preferred embodiment of the present invention. While the scan-driving device 20 of the preferred embodiment is working, the scan-driving circuits 21 perform driving operation to corresponding scan lines one after one, make the LCD display device to form a corresponding frame. After all scan-driving circuits 20 finish the driving operation, the last one of the scan-driving circuits 20 will generate a current-stage down-transfer signal ST_N to the first one of the dummy scan-driving circuits 24. Based on the previous-stage down-transfer signal ST_N−1 and the current-stage clock signal, the first dummy scan-driving circuit 24 generates the current-stage down-transfer signal ST_N and transmits it to the detective-driving circuit 22.

The steps of the detective-driving circuit 22 performing a detective operation will be described below:

First, the detective-driving circuit 22 receives the previous-stage down-transfer signal ST_N−1 with high potential, the tenth switch T10 of the up-pull-control module 221 is ON, and the output terminal of the tenth switch T10 outputs the scan-voltage signal Q_N of the scan line, which is high potential. The scan-voltage signal Q_N of the scan line accumulates at the bootstrap capacitor C.

Then, the previous-stage down-transfer signal ST_N−1 switches to low potential, the tenth switch T10 of the up-pull-control module 221 is OFF, the eleventh switch T11 of the up-pull module 222 is ON under the action of the bootstrap capacitor C, the clock signal CK with high potential is inputted to the input terminal of the eleventh switch T11, and the output terminal of the eleventh switch T11 outputs the current-stage scan signal G_N.

Meanwhile, the twelfth switch T12 of the down-transfer module 223 is ON under the action of the bootstrap capacitor C, the clock signal CK with high potential is inputted to the input terminal of the twelfth switch T12, and the output terminal of the twelfth switch T12 outputs the current-stage down-transfer signal ST_N.

While the previous-stage down-transfer signal ST_N−1 is at high potential, the first switch T1 of the down-pull-sustain module 225 is ON, and the output terminal of the third switch T3 outputs the control signal DCH to the common voltage source VSS through the first switch T1. Meanwhile, the fourth switch T4 and the fifth switch T5 are OFF to well keep high potential of the scan-voltage signal Q_N of the scan line.

While the current-stage down-transfer signal ST_N is at high potential, the second switch T2 of the down-pull-sustain module 225 is ON, the output terminal of the third switch T3 outputs the control signal DCH to the common voltage source VSS through the second switch T2. Meanwhile, the fourth switch T4 and the fifth switch T5 are OFF to well keep high potentials of the scan-voltage signal Q_N of the scan line and the current-stage scan signal G_N.

Then, the next-stage scan signal G_N+1 switches to high potential, the thirteenth switch T13 and the fourteenth switch T14 of the down-pull module 224 are ON under the control of the next-stage scan signal G_N+1. The current-stage scan signal G_N discharges through the fourteenth switch T14 to become low potential. The current-stage scan-voltage signal discharges through the thirteenth switch T13 to become low potential.

Meanwhile, the current-stage down-transfer signal S_N and the previous-stage down-transfer signal ST_N−1 both switch to low potentials, the first switch T1 and the second switch T2 of the down-pull-sustain module 225 are OFF, and the output terminal of the third switch T3 outputs the control signal DCH to the control terminal of the fourth switch T4 and the control terminal of the fifth switch T5. The fourth switch T4 is ON, and the common voltage source VSS is able to well keep the scan-voltage signal Q_N at low potential by the fourth switch T4. The fifth switch T5 at the same time is ON, and the common voltage source VSS is able to well keep the current-stage scan signal G_N at low potential by the fifth switch T5.

Finally, a generation process of the scan signal G_N of the detective-driving circuit 22 of the scan-driving device 20 of the preferred embodiment is completed; the scan signal G_N is not really outputted to the scan line.

While the fourth switch T4 is ON, the ninth switch T9 of the detecting module 227 is ON under the control of the detected voltage DET, it is able to detect the detected current I, an ON-current of the ninth switch T9. According to the amount of the detected current I, a level of the threshold-voltage-drift of the fourth switch T4 is able to be determined. Then, the modulating module 23 can perform adjustments to the scan-driving circuit 21, the detective-driving circuit 22, and the control signal DCH of the dummy scan-driving circuits 24, according to the level of the threshold-voltage-drift of the fourth switch T4, to ensure the normal ON and OFF of the scan-driving circuit 21, the detective-driving circuit 22, the fourth switch T4 and the fourth switch T5 of the dummy scan-driving circuits 24.

Then, a scanning of the scan-driving circuit 21 of the scan-driving device 20 and the control signal adjustment process of the modulating module 23 of the preferred embodiment are completed.

The scan-driving device of the present invention is able to better maintain the ability of down-pull-sustain of the down-pull-sustain module by disposing the detective-driving circuit, whereby the stability of the scan-driving device is increased, with the disposition of the detective-driving circuit.

Figure 4:
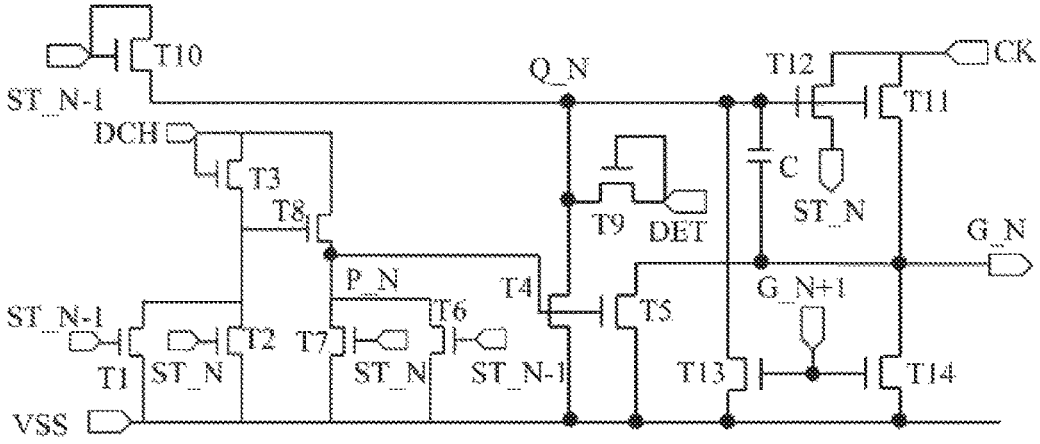
FIG. 4 is a structural illustrative drawing of a detective-driving circuit of the scan-driving device of a second preferred embodiment of the present invention.

Please refer to FIG. 4, which is a structural illustrative drawing of a detective-driving circuit of the scan-driving device of a second preferred embodiment of the present invention. The difference between the second preferred embodiment and the first preferred embodiment is that the down-pull-sustain module 225 comprises a first switch T1, a second switch T2, a third switch T3, a fourth switch T4, a fifth switch T5, a sixth switch T6, a seventh switch T7, and an eighth switch T8.

A control terminal of the first switch T1 is inputted with the previous-stage down-transfer signal ST_N−1, an input terminal of the first switch T1 is connected with an output terminal of the third switch T3, and an output terminal of the first switch T1 is connected with a common voltage source VSS.

A control terminal of the second switch T2 is inputted with the current-stage down-transfer signal ST_N, an input terminal of the second switch T2 is connected with the output terminal of the third switch T3, and an output terminal of the second switch T2 is connected with the common voltage source VSS.

A control terminal of the third switch T3 is inputted with the control signal DCH, an input terminal of the third switch T3 is also inputted with the control signal DCH, and an output terminal of the third switch T3 is connected with a control terminal of the eighth switch T8.

An input terminal of the fourth switch T4 is inputted with the scan-voltage signal Q_N of the scan line, and an output terminal of the fourth switch T4 is connected with the common voltage source VSS.

An input terminal of the fifth switch T5 is inputted with the scan signal G_N of the scan line, and an output terminal of the fifth switch T5 is connected with the common voltage source VSS.

A control terminal of the sixth switch T6 is inputted with the previous-stage down-transfer signal ST_N−1, an input terminal of the sixth switch T6 is connected with an output terminal of the eighth switch T8, and an output terminal of the sixth switch T6 is connected with the common voltage source VSS.

A control terminal of the seventh switch T7 is inputted with the current-stage down-transfer signal ST_N, an input terminal of the seventh switch T7 is connected with the output terminal of the eighth switch T8, and an output terminal of the seventh switch T7 is connected with the common voltage source VSS.

A control terminal of the eighth switch T8 is inputted with the control signal DCH, and an output terminal of the eighth switch T8 is connected with a control terminal of the fourth switch T4 and a control terminal of the fifth switch T5.

The actual operation principle of the scan-driving device having the detective-driving circuit of the second preferred embodiment and the first preferred embodiment are the same, please refer to the relative description of the scan-driving device having the detective-driving circuit of the first preferred embodiment.

The detective-driving circuit of the scan-driving device of the second preferred embodiment further increases the working stability of the down-pull-sustain module by disposing the sixth switch T6, the seventh switch T7, and the eighth switch T8.

Figure 5:
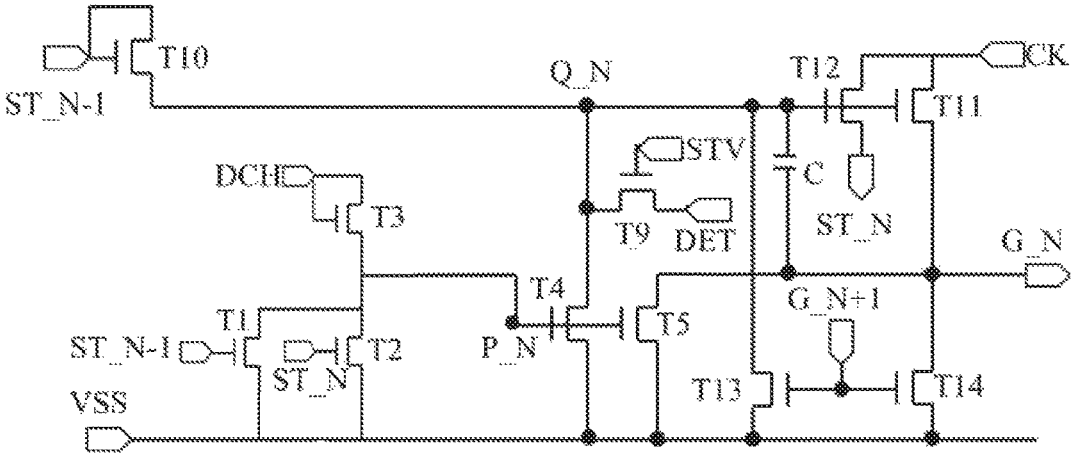
FIG. 5 is a structural illustrative drawing of a detective-driving circuit of the scan-driving device of a third preferred embodiment of the present invention.

Please refer to FIG. 5, which is a structural illustrative drawing of a detective-driving circuit of the scan-driving device of a third preferred embodiment of the present invention. The difference between the third preferred embodiment and the first preferred embodiment is that the control terminal of the ninth switch T9 of the detecting module is inputted with the starting signal STV, the input terminal of the ninth switch T9 is inputted with the detected voltage DET, and the output terminal of the ninth terminal T9 connects with the input terminal of the fourth switch T4.

The actual operation principle of the scan-driving device having the detective-driving circuit of the second preferred embodiment and the first preferred embodiment are the same, please refer to the relative description of the scan-driving device having the detective-driving circuit of the first preferred embodiment.

The detecting module of the detective-driving circuit of scan-driving device of the third preferred embodiment performs the detection of the threshold-voltage-drift of the control switch of the down-pull-sustain module by the starting signal, which is more precise in detecting the stating time to derive a better detected result.

Figure 6:
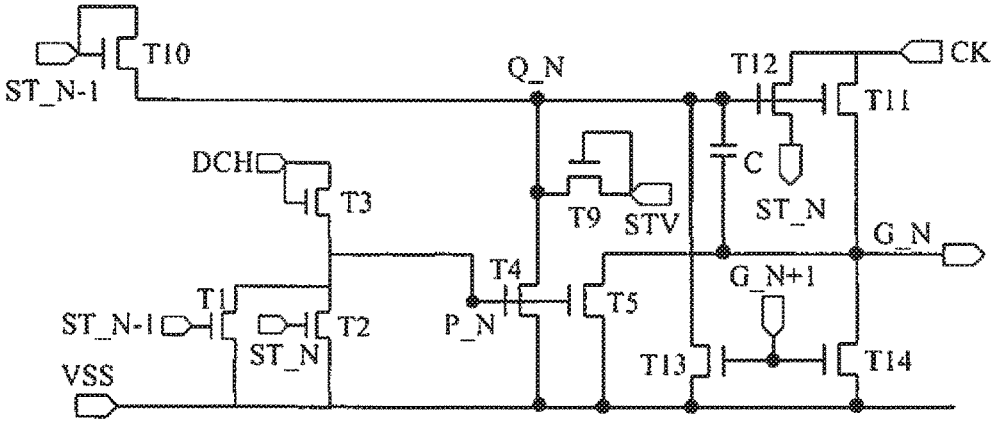
FIG. 6 is a structural illustrative drawing of a detective-driving circuit of the scan-driving device of a fourth preferred embodiment of the present invention.
Figure 7:
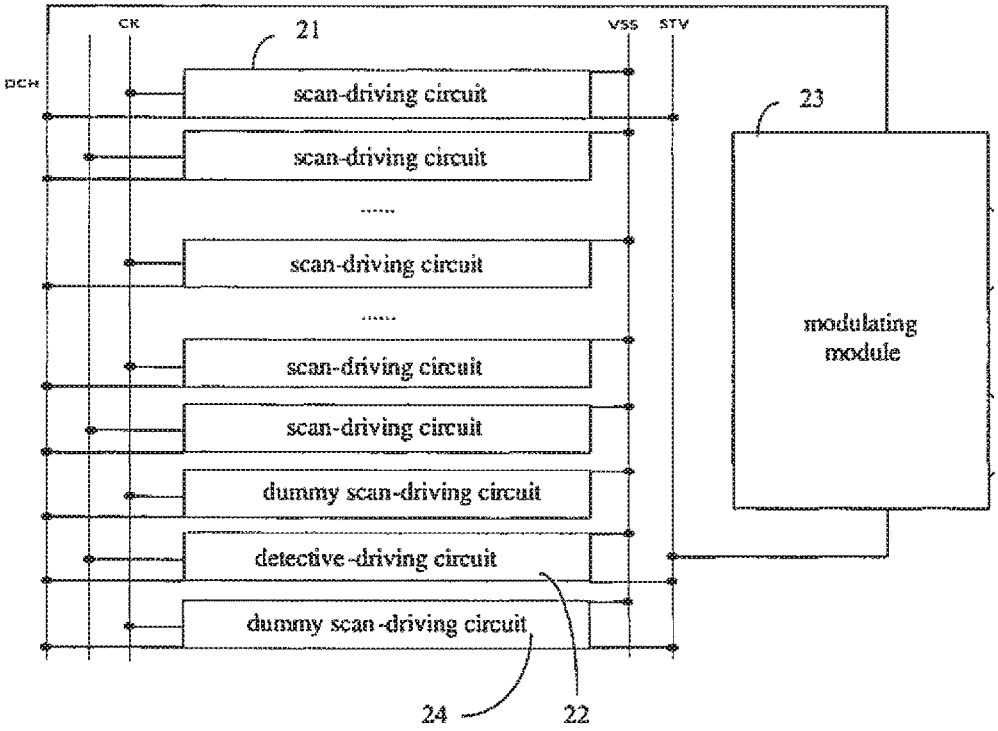
FIG. 7 is a structural illustrative drawing of the scan-driving device of an alternative preferred embodiment of the present invention.

Please refer to FIG. 6 and FIG. 7. FIG. 6 is a structural illustrative drawing of a detective-driving circuit of the scan-driving device of a fourth preferred embodiment of the present invention. FIG. 7 is a structural illustrative drawing of the scan-driving device of an alternative embodiment of the present invention which has the detective-driving circuit of the fourth embodiment. The difference between the fourth preferred embodiment and the first preferred embodiment is that the control terminal and the input terminal of the ninth switch T9 of the detecting module of the detective-driving circuit are inputted with the starting signal STV, and the output terminal of the ninth terminal T9 connects with the input terminal of the fourth switch T4.

The detecting module of detective-driving circuit of the scan-driving device of the fourth preferred embodiment performs the detection of the threshold-voltage-drift of the control switch of the down-pull-sustain module, merely by the starting signal, hence, it is able to directly output the detected current I through a transmitting line for the starting signal STV, without a transmitting line specially for the detected voltage DET; please refer FIG. 2 and FIG. 7 for details, from which it can be seen that the scan-driving device of FIG. 7 does not have the line for the detected voltage DET. Hence, based on ensuring the same detected result, the manufacturing cost of the scan-driving device of FIG. 7 is decreased.

The actual operation principle of the scan-driving device of the alternative preferred embodiment of FIG. 7 and the previous preferred embodiment of FIG. 2 are the same, please refer to the relative description of the scan-driving device of the previous preferred embodiment.

With the detective-driving circuit in the scan-driving device of the present invention, it is able to better maintain the ability of down-pull-sustain of the down-pull-sustain module, to solve the technical problem of the decrease of the ability of down-pull-sustain of the down-pull-sustain module of the conventional art, wherein such a decrease in the ability may lead to the scan-driving circuit failure.

Although the present invention has been disclosed as preferred embodiments, the foregoing preferred embodiments are not intended to limit the present invention. Those of ordinary skill in the art, without departing from the spirit and scope of the present invention, can make various kinds of modifications and variations to the present invention. Therefore, the scope of the claims of the present invention must be defined.

What is claimed is:

1. A scan-driving device, comprising:

a plurality of scan-driving circuits, being used to perform driving operations on cascaded scan lines;

a detective-driving circuit, being used to detect a threshold-voltage-drift of a control switch of a down-pull-sustain module of the scan-driving circuit; and a plurality of dummy scan-driving circuits, being disposed before or after all of the scan-driving circuits of the scan-driving device, to filter unstable input signals, wherein the scan-driving circuit comprises:

a pull-up-control module, being used to receive a previous-stage down-transfer signal, and correspondingly generate a scan-voltage signal of a scan line according to the previous-stage down-transfer signal;

a pull-up module, being used to pull up a corresponding scan signal of the scan line according to the scan-voltage signal and a current-stage clock signal;

a down-transfer module, being used to transmit a current-stage down-transfer signal to a next-stage pull-up-control module;

a down-pull module, being used to pull down the corresponding scan signal of the scan line, according to a next-stage scan signal;

a down-pull-sustain module, being used to maintain low potential of the corresponding scan signal of the scan line, by using the control signal;

and a bootstrap capacitor, being used to generate high potential of the corresponding scan signal of the scan line, wherein the detective-driving circuit comprises:

a pull-up-control module, being used to receive a previous-stage down-transfer signal, and correspondingly generate a scan-voltage signal of the scan line according to the previous-stage down-transfer signal;

a pull-up module, being used to pull up a corresponding scan signal of the scan line according to the scan-voltage signal and a current-stage clock signal;

a down-transfer module, being used to transmit a current-stage down-transfer signal to a next-stage pull-up-control module;

a pull-down module, being used to pull down the corresponding scan signal of the scan line, according to a next-stage scan signal;

a down-pull-sustain module, being used to maintain low potential of the corresponding scan signal of the scan line, by using the control signal;

a bootstrap capacitor, being used to generate high potential of the corresponding scan signal of the scan line; and a detecting module, being used to derive a corresponding detected current under the action of a detected voltage and/or a starting signal, and to detect the threshold-voltage-drift of the control switch of the down-pull-sustain module of at least one of the scan-driving circuits, and wherein, according to a detected result of the detective-driving circuit, a control signal of the down-pull-sustain module is adjusted.

2. The scan-driving device according to claim 1, wherein the down-pull-sustain module of the detective-driving circuit comprises a first switch, a second switch, a third switch, a fourth switch, and a fifth switch;

a control terminal of the first switch is inputted with the previous-stage down-transfer signal, an input terminal of the first switch is connected with an output terminal of the third switch, and an output terminal of the first switch is connected with a common voltage source;

a control terminal of the second switch is inputted with the current-stage down-transfer signal, an input terminal of the second switch is connected with the output terminal of the third switch, and an output terminal of the second switch is connected with the common voltage source;

a control terminal of the third switch is inputted with the control signal, an input terminal of the third switch is also inputted with the control signal, and an output terminal of the third switch is connected with a control terminal of the fourth switch and a control terminal of the fifth switch;

an input terminal of the fourth switch is inputted with the scan-voltage signal of the scan line, and an output terminal of the fourth switch is connected with the common voltage source; and an input terminal of the fifth switch is inputted with the scan signal of the scan line, and an output terminal of the fifth switch is connected with the common voltage source.

3. The scan-driving device according to claim 2, wherein the detecting module comprises a sixth switch, a control terminal of the sixth switch and an input terminal of the sixth switch are inputted with the detected voltage, and an output terminal of the sixth switch is connected with the input terminal of the fourth switch.

4. The scan-driving device according to claim 2, wherein the detecting module of the detective-driving circuit comprises a sixth switch, a control terminal of the sixth switch and an input terminal of the sixth switch are inputted with the starting signal, and an output terminal of the sixth switch is connected with the input terminal of the fourth switch.

5. The scan-driving device according to claim 4, wherein the pull-up-control module of the scan-driving circuit and the detective-driving circuit respectively comprises a seventh switch, a control terminal of the seventh switch is inputted with the previous-stage down-transfer signal, an input terminal of the seventh switch is inputted with the previous-stage down-transfer signal, and an output terminal of the seventh switch is connected with the pull-up module, the pull-down module, the down-pull-sustain module, the down-transfer module, and the bootstrap capacitor;

the pull-up module comprises an eighth switch, a control terminal of the eighth switch is connected with the output terminal of the seventh switch, an input terminal of the eighth switch is inputted with the current-stage clock signal, and an output terminal of the eighth switch outputs a current-stage scan signal;

the down-transfer module comprises a ninth switch, a control terminal of the ninth switch is connected with the output terminal of the seventh switch, an input terminal of the ninth switch is inputted with the current-stage clock signal, and an output terminal of the ninth switch outputs the current-stage down-transfer signal;

the pull-down module comprises a tenth switch and an eleventh switch, a control terminal of the tenth switch is inputted with the next-stage scan signal, an input terminal of the tenth switch is connected with the output terminal of the sixth switch, and an output terminal of the tenth switch is connected with the common voltage source;

a control terminal of the eleventh switch is inputted with the next-stage scan signal, an input terminal of the eleventh switch is connected with the current-stage scan signal, and an output terminal of the eleventh switch is connected with the common voltage source; and the bootstrap capacitor is disposed between the output terminal of the seventh switch and the output terminal of the eighth switch.

6. The scan-driving device according to claim 1, wherein the down-pull-sustain module of the detective-driving circuit comprises a first switch, a second switch, a third switch, a fourth switch, a fifth switch, a sixth switch, a seventh switch, and an eighth switch;

a control terminal of the first switch is inputted with the previous-stage down-transfer signal, an input terminal of the first switch is connected with an output terminal of the third switch, and an output terminal of the first switch is connected with a common voltage source;

a control terminal of the second switch is inputted with the current-stage down-transfer signal, an input terminal of the second switch is connected with the output terminal of the third switch, and an output terminal of the seventh switch is connected with the common voltage source;

a control terminal of the third switch is inputted with the control signal, an input terminal of the third switch is also inputted with the control signal, and an output terminal of the third switch is connected with a control terminal of the eighth switch;

an input terminal of the fourth switch is inputted with the scan-voltage signal of the scan line, and an output terminal of the fourth switch is connected with the common voltage source;

an input terminal of the fifth switch is inputted with the scan signal of the scan line, and an output terminal of the fifth switch is connected with the common voltage source;

a control terminal of the sixth switch is inputted with the previous-stage down-transfer signal, and an input terminal of the sixth switch is connected with an output terminal of the eighth switch, and an output terminal of the sixth switch is connected with the common voltage source;

a control terminal of the seventh switch is inputted with the current-stage down-transfer signal, an input terminal of the seventh switch is connected with the output terminal of the eighth switch, and an output terminal of the seventh switch is connected with the common voltage source; and a control terminal of the eighth switch is inputted with the control signal, and an output terminal of the eighth switch is connected with a control terminal of the fourth switch and a control terminal of the fifth switch.

7. The scan-driving device according to claim 6, wherein the detecting module comprises a ninth switch, a control terminal of the ninth switch is inputted with the starting signal, an input terminal of the ninth switch is inputted with the detected voltage, and an output terminal of the ninth switch is connected with the input terminal of the fourth switch.

8. The scan-driving device according to claim 1, wherein the detecting module is disposed within one of the dummy scan-driving circuits.

9. The scan-driving device according to claim 1, wherein the detecting module is disposed between two of the dummy scan-driving circuits which are in a front part of the scan-driving device.

10. The scan-driving device according to claim 1, wherein the detecting module is disposed between two of the dummy scan-driving circuits which are in a rear part of the scan-driving device.

11. A scan-driving device, comprising:

a plurality of scan-driving circuits, being used to perform driving operations on cascaded scan lines; and a detective-driving circuit, being used to detect a threshold-voltage-drift of a control switch of a down-pull-sustain module of the scan-driving circuit, wherein the scan-driving circuit comprises:

a pull-up-control module, being used to receive a corresponding previous-stage down-transfer signal, and correspondingly generate a scan-voltage signal of a scan line according to the previous-stage down-transfer signal;

a pull-up module, being used to pull up a corresponding scan signal of the scan line according to the scan-voltage signal and a current-stage clock signal;

a down-transfer module, being used to transmit a current-stage down-transfer signal to a next-stage pull-up-control module;

a pull-down module, being used to pull down the corresponding scan signal of the scan line, according to a next-stage scan signal;

a down-pull-sustain module, being used to maintain low potential of the corresponding scan signal of the scan line, by using the control signal; and a bootstrap capacitor, being used to generate high potential of the corresponding scan signal of the scan line, wherein the detective-driving circuit comprises:

a pull-up-control module, being used to receive a previous-stage down-transfer signal, and correspondingly generate a scan-voltage signal of the scan line according to the previous-stage down-transfer signal;

a pull-up module, being used to pull up a corresponding scan signal of the scan line according to the scan-voltage signal and a current-stage clock signal;

a down-transfer module, being used to transmit a current-stage down-transfer signal to a next-stage pull-up-control module;

a pull-down module, being used to pull down the corresponding scan signal of the scan line, according to a next-stage scan signal;

a down-pull-sustain module, being used to maintain low potential of the corresponding scan signal of the scan line, by using the control signal;

a bootstrap capacitor, being used to generate high potential of the corresponding scan signal of the scan line; and a detecting module, being used to derive a corresponding detected current under the action of a detected voltage and/or a starting signal, and to detect the threshold-voltage-drift of the control switch of the down-pull-sustain module, and wherein, according to a detected result of the detective-driving circuit, a control signal of the down-pull-sustain module is adjusted.

12. The scan-driving device according to claim 11, wherein the down-pull-sustain module of the detective-driving circuit comprises a first switch, a second switch, a third switch, a fourth switch, and a fifth switch;

a control terminal of the first switch is inputted with the previous-stage down-transfer signal, an input terminal of the first switch is connected with an output terminal of the third switch, and an output terminal of the first switch is connected with a common voltage source;

a control terminal of the second switch is inputted with the current-stage down-transfer signal, an input terminal of the second switch is connected with the output terminal of the third switch, and an output terminal of the second switch is connected with the common voltage source;

a control terminal of the third switch is inputted with the control signal, an input terminal of the third switch is also inputted with the control signal, and an output terminal of the third switch is connected with a control terminal of the fourth switch and a control terminal of the fifth switch;

an input terminal of the fourth switch is inputted with the scan-voltage signal of the scan line, and an output terminal of the fourth switch is connected with the common voltage source; and an input terminal of the fifth switch is inputted with the scan signal of the scan line, and an output terminal of the fifth switch is connected with the common voltage source.

13. The scan-driving device according to claim 12, wherein the detecting module comprises a sixth switch, a control terminal of the sixth switch and an input terminal of the sixth switch is inputted with the detected voltage, and an output terminal of the sixth switch is connected with the input terminal of the fourth switch.

14. The scan-driving device according to claim 12, wherein the detecting module comprises a sixth switch, a control terminal of the sixth switch and an input terminal of the sixth switch are inputted with the starting signal, and an output terminal of the sixth switch is connected with the input terminal of the fourth switch.

15. The scan-driving device according to claim 14, wherein the pull-up-control module of the scan-driving circuit and the detective-driving circuit respectively comprises a seventh switch, a control terminal of the seventh switch is inputted with the previous-stage down-transfer signal, an input terminal of the seventh switch is inputted with the previous-stage down-transfer signal, and an output terminal of the seventh switch is connected with the pull-up module, the pull-down module, the down-pull-sustain module, the down-transfer module, and the bootstrap capacitor;

the pull-up module comprises an eighth switch, a control terminal of the eighth switch is connected with the output terminal of the seventh switch, an input terminal of the eighth switch is inputted with the current-stage clock signal, and an output terminal of the eighth switch outputs a current-stage scan signal;

the down-transfer module comprises a ninth switch, a control terminal of the ninth switch is connected with the output terminal of the seventh switch, an input terminal of the ninth switch is inputted with the current-stage clock signal, and an output terminal of the ninth switch outputs the current-stage down-transfer signal;

the pull-down module comprises a tenth switch and an eleventh switch, a control terminal of the tenth switch is inputted with the next-stage scan signal, an input terminal of the tenth switch is connected with the output terminal of the sixth switch, and an output terminal of the tenth switch is connected with the common voltage source;

a control terminal of the eleventh switch is inputted with the next-stage scan signal, an input terminal of the eleventh switch is connected with the current-stage scan signal, and an output terminal of the eleventh switch is connected with the common voltage source; and the bootstrap capacitor is disposed between the output terminal of the seventh switch and the output terminal of the eighth switch.

16. The scan-driving device according to claim 11, wherein the down-pull-sustain module of the detective-driving circuit comprises a first switch, a second switch, a third switch, a fourth switch, a fifth switch, a sixth switch, a seventh switch, and an eighth switch;

a control terminal of the first switch is inputted with the previous-stage down-transfer signal, an input terminal of the first switch is connected with an output terminal of the third switch, and an output terminal of the first switch is connected with a common voltage source;

a control terminal of the second switch is inputted with the current-stage down-transfer signal, an input terminal of the second switch is connected with the output terminal of the third switch, and an output terminal of the seventh switch is connected with the common voltage source;

a control terminal of the third switch is inputted with the control signal, an input terminal of the third switch is also inputted with the control signal, and an output terminal of the third switch is connected with a control terminal of the eighth switch;

an input terminal of the fourth switch is inputted with the scan-voltage signal of the scan line, and an output terminal of the fourth switch is connected with the common voltage source;

an input terminal of the fifth switch is inputted with the scan signal of the scan line, and an output terminal of the fifth switch is connected with the common voltage source;

a control terminal of the sixth switch is inputted with the previous-stage down-transfer signal, an input terminal of the sixth switch is connected with an output terminal of the eighth switch, and an output terminal of the sixth switch is connected with the common voltage source;

a control terminal of the seventh switch is inputted with the current-stage down-transfer signal, an input terminal of the seventh switch is connected with the output terminal of the eighth switch, and an output terminal of the seventh switch is connected with the common voltage source; and a control terminal of the eighth switch is inputted with the control signal, and an output terminal of the eighth switch is connected with a control terminal of the fourth switch and a control terminal of the fifth switch.

17. The scan-driving device according to claim 16, wherein the detecting module comprises a ninth switch, a control terminal of the ninth switch is inputted with the starting signal, an input terminal of the ninth switch is inputted with the detected voltage, an output terminal of the ninth switch is connected with the input terminal of the fourth switch.

18. The scan-driving device according to claim 11, wherein the scan-driving device comprises a plurality of dummy scan-driving circuits, being disposed before or behind all of the scan-driving circuits of the scan-driving device, to filter unstable input signals.

19. The scan-driving device according to claim 11, wherein the detecting module is disposed within one of the dummy scan-driving circuits, is disposed between two of the dummy scan-driving circuits which are in a front part of the scan-driving device, or is disposed between two of the dummy scan-driving circuits which are in a rear part of the scan-driving device.

* * * * *